US006431905B2

(12) United States Patent
Verbeek et al.

(10) Patent No.: US 6,431,905 B2
(45) Date of Patent: Aug. 13, 2002

(54) CABLE CONNECTOR

(75) Inventors: Robert Verbeek, Hombeek; Tom Ceuppens, Sint Katelijne-Waver; Wim Vervoort, Broechem, all of (BE)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/774,511

(22) Filed: Jan. 31, 2001

(30) Foreign Application Priority Data

Jan. 31, 2000 (NL) ..... 1014236

(51) Int. Cl.[7] ..... H01R 13/58
(52) U.S. Cl. ..... 439/456; 439/701
(58) Field of Search ..... 439/456, 607, 439/701, 362

(56) References Cited

U.S. PATENT DOCUMENTS 4,153,326 A * 5/1979 Frantz et al.
4,484,792 A * 11/1984 Tengler et al.
5,073,127 A 12/1991 Daly et al. ..... 439/473
5,346,412 A 9/1994 Fedder et al. ..... 439/681
5,419,721 A 5/1995 Lignelet ..... 439/701
6,225,557 B1 * 5/2001 Fonteneau et al. ..... 439/456

FOREIGN PATENT DOCUMENTS

EP 0907221 A2 4/1999
EP 0986135 A1 3/2000
EP 0987790 A1 3/2000

* cited by examiner

*Primary Examiner*—Khiem Nguyen
(74) *Attorney, Agent, or Firm*—Perman & Green, LLP

(57) ABSTRACT

A cable connector comprises a housing of insulating material, the housing having a plurality of contact terminals, and a metal cover having a first end for accommodating the housing and a second end with a cable exit. The metal cover comprises a location for receiving a strain relief means of the cable near the second end. The cover is provided with at least two cable exits and two locations for receiving a strain relief means. The receiving locations are staggered with respect to each other in the direction from the first to the second end, and/or the receiving locations are placed at an offset with respect to a center plane of the connector in mutually opposite directions.

4 Claims, 5 Drawing Sheets

CABLE CONNECTOR

BACKGROUND OF THE INVENTION

1. Field of the Invention

The invention relates to a cable connector, comprising a housing of insulating material, said housing having a plurality of contact terminals, and a metal cover having a first end for accommodating the housing and a second end with a cable exit, wherein the metal cover comprises a location for receiving a strain relief means of the cable near the second end.

2. Description of Prior Developments

A cable connector of this type is described in EP-A-0 907 221. This known cable connector shows a design which is very efficient in applications where one or more cables are exiting straight from the cover or in applications where a signal cable exits from the cover at a right angle. In some applications of cable connectors with at least two cables, the overall length or height of the cable connector is significantly increased when the cables should laterally exit at a right angle from the cover. In such applications of the cable connector of EP-A-0 907 221 the cable connector would require too much space.

Further cable connectors of the above-mentioned type are shown in European patent applications 99202938.9 and 99202973.6 of the same applicant.

SUMMARY OF THE INVENTION

The invention aims to provide an improved cable connector of the above-mentioned type, which cable connector is in particular efficient in applications where at least two cables exit at a right angle from the cover.

To this end the cable connector of the invention is characterized in that the cover is provided with at least two cable exits and two locations for receiving a strain relief means, wherein said receiving locations are staggered with respect to each other in the direction from the first to the second end, and/or wherein the receiving locations are placed at an offset with respect to a center plane of the connector in mutually opposite directions.

In this manner a cable connector is obtained, wherein the overall space required for the connector and cables exiting the connector is reduced. Further, in particular in an embodiment with offset receiving locations, the cables can extend parallel to each other at mainly the same level immediately outside the connector cover.

According to a preferred embodiment the metal cover is provided with a cable guiding channel between each cable exit and corresponding receiving location, wherein each cable channel comprises a bend section. In this manner the cables are forced by the guiding channels into a lateral direction already within the connector.

BRIEF DESCRIPTION OF THE DRAWINGS

The invention will be further explained by reference to the drawings in which an embodiment of the connector of the invention is schematically shown.

DESCRIPTION OF THE PREFERRED EMBODIMENTS

Figure 1:
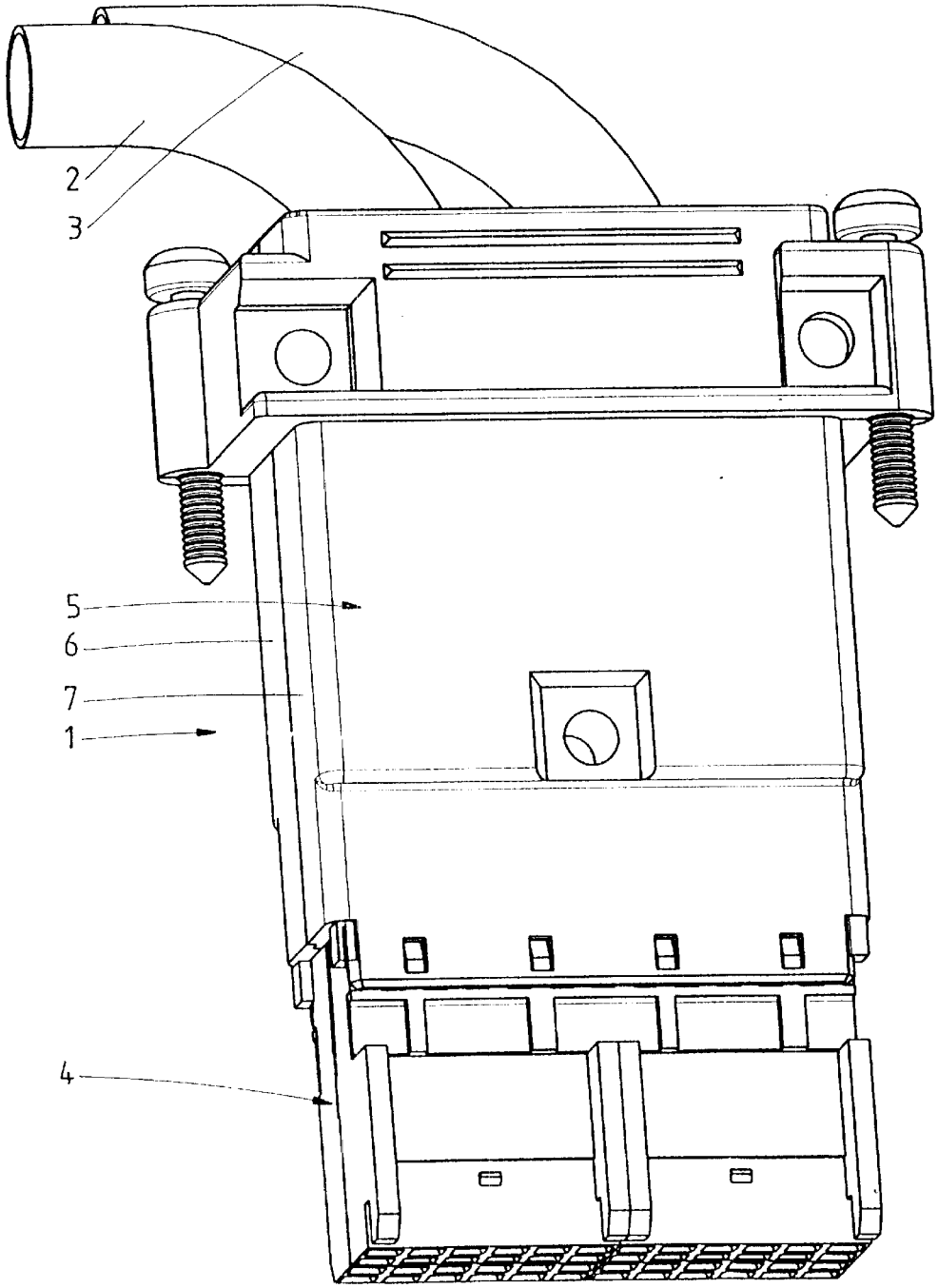
FIG. 1 shows a perspective view of an embodiment of the cable connector of the invention with two cables exiting the cover in a lateral direction.
Figure 5:
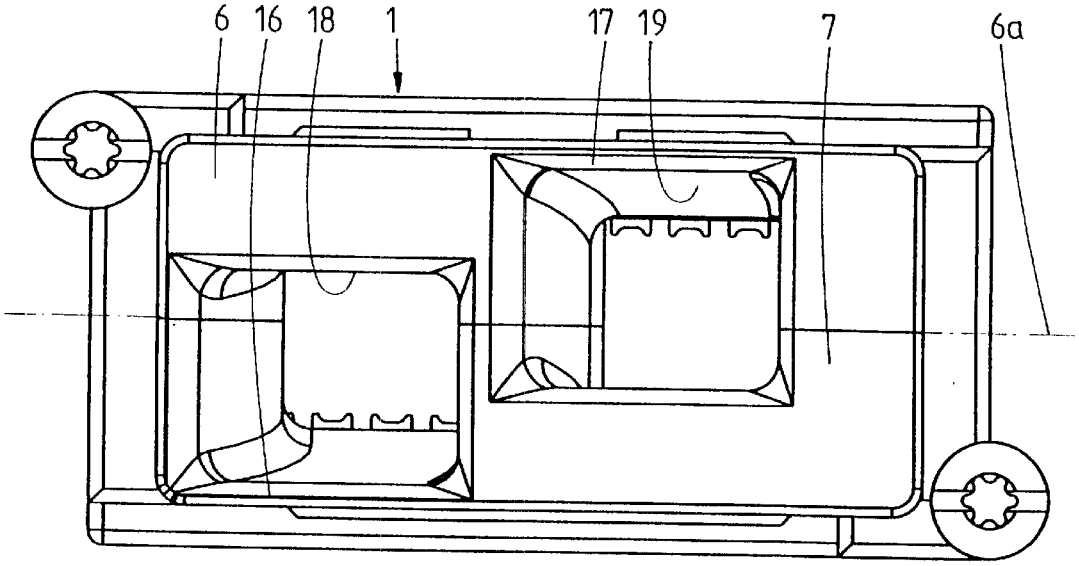
FIG. 5 is a top view of the complete cable connector of FIG. 1 without cables.

FIG. 1 shows a cable connector 1 with two cables 2 and 3 exiting the cable connector at the top end in a lateral direction. The cable connector 1 comprises a housing 4 of insulating material and a metal cover 5 including a first cover half 6 and a second cover half 7. The cover halves 6,7 are separated in a center plane of the connector 1 schematically indicated in FIG. 5 by a dashed line 6*a*. It is noted that the cover 5 can be manufactured of any conductive material adapted to operate as a shielding, including a metal coated plastic material. In the present specification and claims "metal" cover should be understood as meaning a cover made of any such suitable conductive material.

Figure 2:
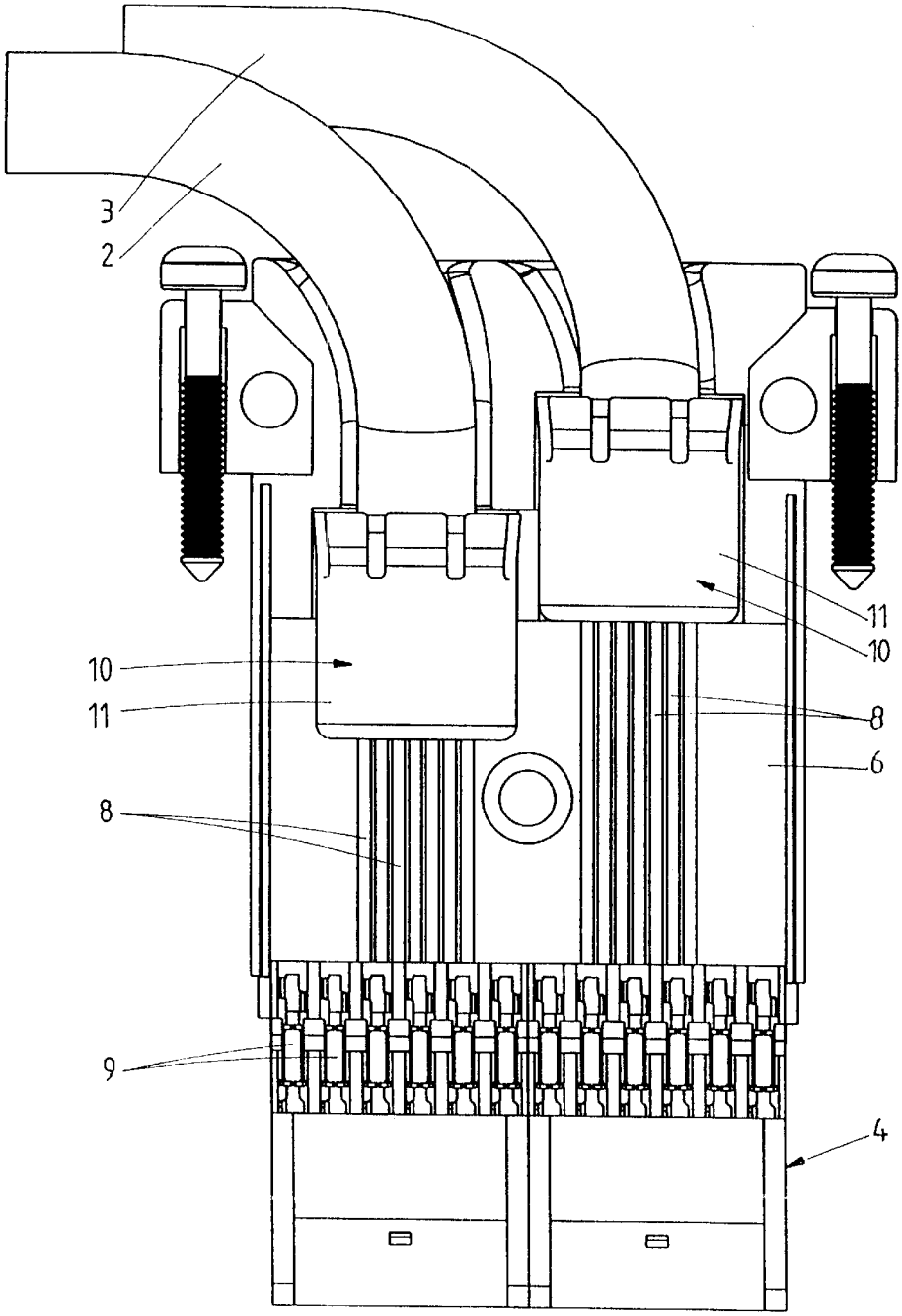
FIG. 2 is a side view of the cable connector of FIG. 1 with one cover half taken away.

FIG. 2 shows the cable connector 1 of FIG. 1, wherein cover half 7 is removed to show the inner side of the cable connector. It is noted that each cable 2,3 comprises a plurality of wires 8 which are only schematically shown in FIG. 2. The housing 4 of insulating material is provided with a plurality of contact terminals 9, preferably made as IDC terminals. In FIG. 2, the wires are not connected to the contact terminals 9 for the sake of clarity.

Each cable 2,3 is provided with a strain relief means 10 connected to the shielding of the cable in a manner not further shown. This strain relief means 10 can comprise an inner ferrule not shown and an outer ferrule 11. The strain relief means 10 and the method for mounting the strain relief means on the cable 2,3 are further described in the above-mentioned European patent application 99202938.9. For a detailed description of the strain relief means reference is made to this document.

Figure 3:
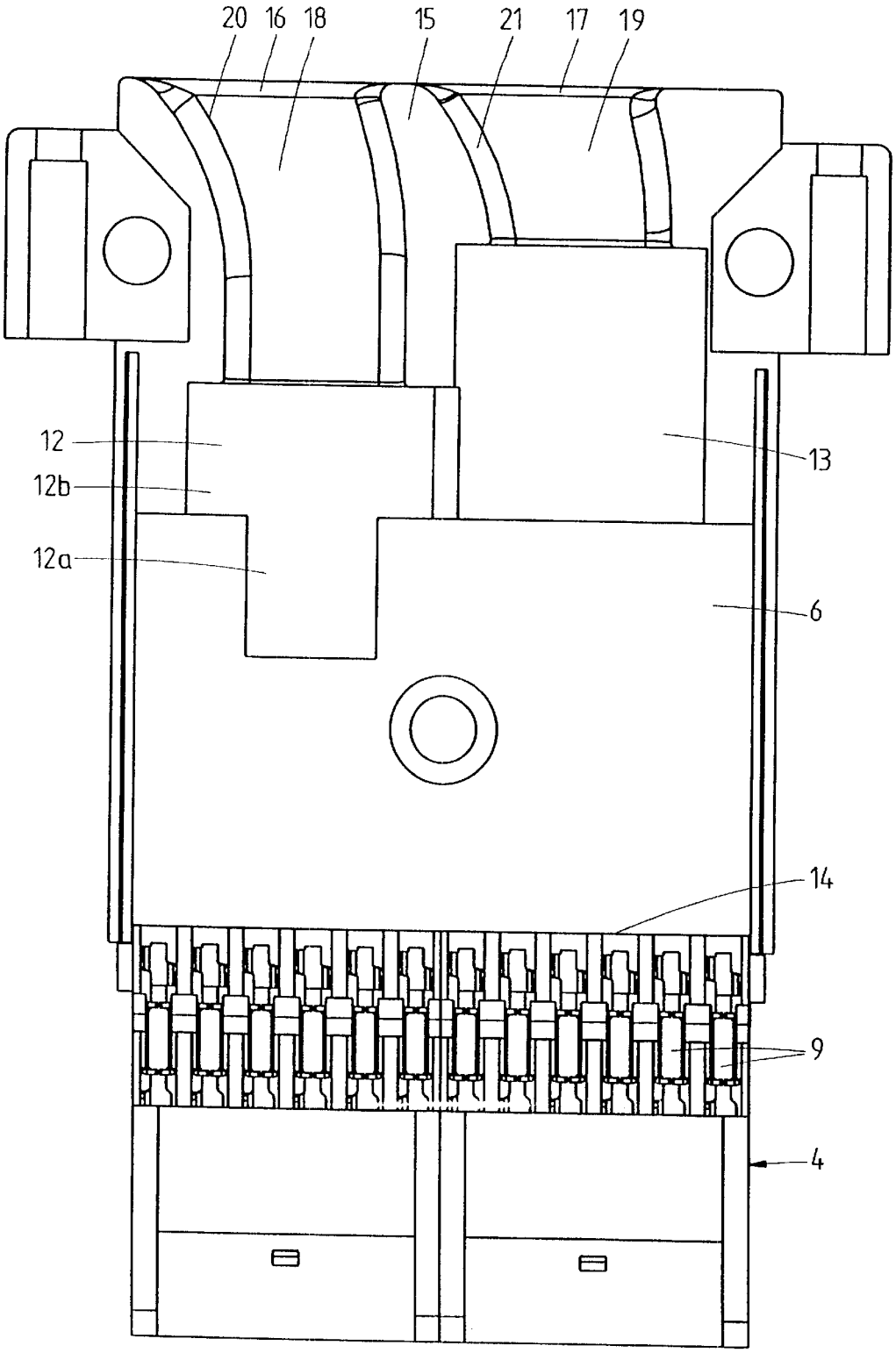
FIGS. 3 and 4 show side views of the inner side of both cover halves without cables.
Figure 4:
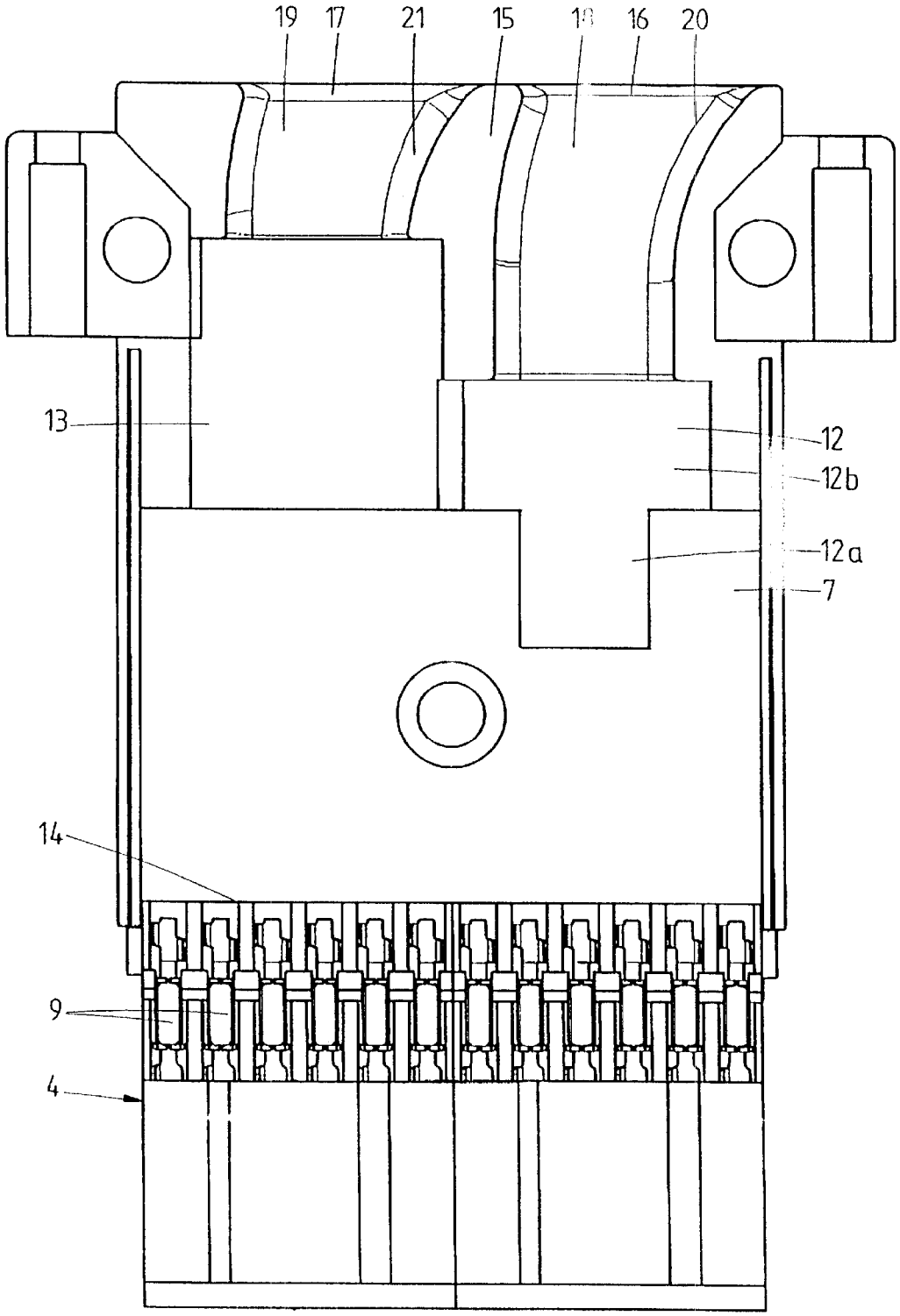

The strain relief means 10 of the cables, 2,3 are received in a receiving location 12 and 13, respectively. The receiving locations 12 and 13 are shown in more detail in FIGS. 3 and 4 showing the inner side of the cover halves 6,7. The cover 5 has a first end 14 for accommodating the housing 4 and a second end 15 having two cable exits 16,17 for the cables 2,3. As can be seen in particular in FIGS. 2–4, the receiving locations 12,13 lying near the second end 15, are staggered with respect to each other in the direction from the first end 14 to the second end 15. In this manner the overall length or height of the cable connector, in particular of the cover 5 can be reduced. Further, the receiving locations 12,13 are placed at an offset with respect to the center plane 6*a* of the connector in mutually opposite directions as can be seen in particular in FIG. 5.

The receiving locations 12,13 each are made as mainly cylindrical chambers, wherein a major half of the cylindrical chamber of receiving location 12 is provided in cover half 7 and a minor half in cover half 6, whereas the cylindrical chamber of receiving location 13 has its major half in cover half 6 and its minor half in cover half 7. As in the lower part of the cover 5 a space is provided for the cable wires 8, the lower part 12*a* of the receiving location 12 has a smaller diameter than the upper part 12*b*.

The cover 5 is provided with cable guiding channels 18,19 for the cables 2,3, respectively. These cable guiding channels 18,19 are located between the cable exits 16,17 and the receiving locations 12,13 and each cable channel 18,19 comprises a bend section 20,21. In the embodiment shown, the bend sections 20,21 each include a curvature in lateral direction mainly parallel to the center plane 6*a* and a curvature in transverse direction mainly perpendicular to the center plane 6*a*. In this manner the cable is forced in a lateral direction in such a manner, that outside the cover 5 the cables 2,3 extend mainly parallel to each other at mainly the same height.

It is noted that although in the described embodiment the receiving locations 12, 13 are both staggered and offset with respect to the center plane 6*a,* it is possible to provide a connector wherein the receiving locations are either staggered or offset. It is further noted that the described connector design can be used in cable connectors with more than two cables.

The invention is not restricted to the above described embodiment which can be varied in a number of ways within the scope of the claims.

What is claimed is:

1. A Cable connector comprising a housing of insulating material, the housing having a plurality of contact terminals and a metal cover having a first end for accommodating the housing and a second end with a cable exit, wherein the metal cover includes a location for receiving a strain relief means of the cable near the second end, wherein the cover is provided with at least two cable exits and two locations for receiving a strain relief means, wherein the receiving locations are staggered with respect to each other in the direction from the first to the second end, and/or wherein the receiving locations are placed at an offset with respect to a center plane of the connector in mutually opposite directions, the metal cover being provided with a cable guiding channel between each cable exit and corresponding receiving location whereby each cable channel includes a bend section.

2. Cable connector according to claim 1, wherein each bend section includes a curvature in a lateral direction mainly parallel to said center plane.

3. Cable connector according to claim 1 wherein each bend section includes a curvature in a transverse direction mainly perpendicular to said center plane.

4. Cable connector according to claim 1, wherein the cover comprises first and second cover halves separated by said center plane, wherein the receiving locations are made as mainly cylindrical chambers, each chamber having a major and a minor half in different cover halves.

* * * * *